US005407210A

United States Patent [19]

Canning

[11] Patent Number: 5,407,210

[45] Date of Patent: Apr. 18, 1995

[54] PORTABLE GAME APPARATUS FOR PLAYING CURB BALL OR OTHER BALL GAME

[76] Inventor: Robert P. Canning, 22 Broadview Ter., Granville, N.Y. 12832

[21] Appl. No.: 151,913

[22] Filed: Nov. 15, 1993

[51] Int. Cl.[6] ..... A63B 67/00

[52] U.S. Cl. ..... 273/348; 52/183; 273/396

[58] Field of Search ..... 273/348, 396, 26 A, 273/394; 52/183

[56] References Cited

U.S. PATENT DOCUMENTS

| | | | |
|---|---|---|---|
| 98,978 | 1/1870 | Kemp et al. | 52/183 |
| 1,125,194 | 1/1915 | Sigmund | 52/183 X |
| 1,818,428 | 8/1931 | Paysen | 52/183 |
| 2,575,593 | 11/1951 | Peery | 52/183 |
| 3,035,671 | 5/1962 | Sicherman | 52/183 |
| 3,346,317 | 10/1967 | Peggs | 52/183 X |
| 3,564,790 | 2/1971 | Rehfeld | 52/183 |
| 3,942,795 | 3/1976 | Psenka | 273/396 X |
| 4,072,295 | 2/1978 | Roberts | 273/26 A X |
| 4,133,531 | 1/1979 | Arteaga et al. | 273/102 R |
| 5,054,791 | 10/1991 | Bau | 273/396 |

*Primary Examiner*—William H. Grieb
*Attorney, Agent, or Firm*—Edward M. Livingston

[57] ABSTRACT

A portable game apparatus for playing curb ball or other ball game either indoors or outdoors, having a plurality of steps (1, 2 and 3) with means for supporting the steps in a flight such that the front face and top edge of each step provides a striking surface for a ball thrown at the apparatus. A net (4) is suspended between poles (5*a* and 5*b*) attached to the top edge (16) of the top step (3) and is preferably angled forwardly at approximately 45°. The net (4) serves as a back stop to keep the ball (9) from going over the top step (3) and also to ricochet the ball (3) toward the striking surfaces underlying steps. The means for supporting the steps (1, 2 and 3) in a flight is provided by supports (7*a* and 7*b*) attached to the first and top steps (3) with dowels (8*a* and 8*b*) connected vertically between the supports (7*a* and 7*b*). Hinges (6*a*, 6*b*, 10*a*, 10*b*, 11*a* and 11*b*) between the steps (1, 2 and 3) and first step supports (7*a* and 7*b*), respectively, and removable dowels (8*a* and 8*b*) make the entire apparatus collapsible for easy storage and handling.

9 Claims, 2 Drawing Sheets

PORTABLE GAME APPARATUS FOR PLAYING CURB BALL OR OTHER BALL GAME

BACKGROUND OF THE INVENTION

This invention relates to game apparatuses and more particularly, to a game apparatus for playing curb ball or other ball game either indoors or outdoors.

Normally, games involving the use of balls require a relatively large area in which to be played and therefore must be played in a large gym indoors or large field outdoors. Furthermore, such ball games normally require a team of players. Moreover, most ball games have complicated rules which require considerable time for one to become proficient; one such example being baseball. Thus, a need exists for a ball game which can be played indoors or outdoors in a relatively small area, does not require a team of players, has rules that are not complicated and which helps teach proficiency in ball handling in preparation for other ball games, such as baseball.

The prior art includes some portable ball game apparatuses, but none like the present invention. For instance, U.S. Pat. No. 4,133,531 by Arteaga et al., issued Jan. 9, 1979, teaches a portable game device for playing step ball, but it does not have a net at the top, has side panels and has different flight supporting means. U.S. Pat. No. 3,035,671 by Sicherman, issued May 22, 1962, teaches portable folding steps, but is not a game device. U.S. Pat. No. 3,346,317 by Peggs, issued Oct. 10, 1967, teaches a folding step-like stand. U.S. Pat. No. 3,564,790 by Rehfeld, issued Feb. 23, 1971, teaches collapsible folding steps. Other U.S. patents, such as U.S. Pat. No. 1,125,194 by Sigmund, issued Jan. 19, 1915; U.S. Pat. No. 98,978, issued Jan. 18, 1870; U.S. Pat. No. 2,575,293 by Peery, issued Nov. 20, 1951; and U.S. Pat. No. 1,818,428 by Paysen, issued Aug. 11, 1931, teach collapsible steps or stands and the use of hinges therefor, but none are apparatuses for ball games with a structure similar to the present invention.

Thus, although the above prior patents may suggest a step-like ball game apparatus and/or collapsible steps, none has the same combination of features as the present invention, including a net, flight-supporting means, using supports and dowels.

SUMMARY OF THE INVENTION

A primary object of the present invention is to provide a game apparatus that can be used to play a ball game indoors or outdoors.

Another object of the present invention is to provide such a device that can be used to play a ball game in a relatively small area.

Yet, another object of the present invention is to provide a game apparatus that can be used to play a ball game by persons of all ages.

A further object of the present invention is to provide such a game apparatus for a ball game that will teach coordination and proficiency in ball handling in preparation for other ball games, such as baseball.

Another object of the present invention is to provide such a game apparatus that is collapsible for easy handling and storage.

The present invention provides the above and other objects by providing a game apparatus that has a plurality of steps arranged in a flight, each step having a face and an edge which the ball may strike when thrown toward the apparatus with a net suspended between two poles attached to opposite ends of a top vertical step. The net is preferably bent toward the face of the steps at an angle of 45°. Means for supporting the steps in a flight include horizontal base supports attached to the bottom step, two vertical back supports attached to the top step and two (2) dowels extending from a hole in the base supports to a hole in the back supports in the top step. The entire game apparatus is collapsible for easy handling and storage, thereby making the game portable. Means for collapsing the flight of steps are provided by hinges between each step and on the base supports to allow the stairs to be folded when the dowels are removed.

The above and other objects and features of the present invention become even more readily apparent when a preferred embodiment is described in detail in conjunction with the drawings.

BRIEF DESCRIPTION OF THE DRAWING

The drawings used in conjunction with describing a preferred embodiment of the invention are as follows.

DESCRIPTION OF THE PREFERRED EMBODIMENTS

Figure 1:
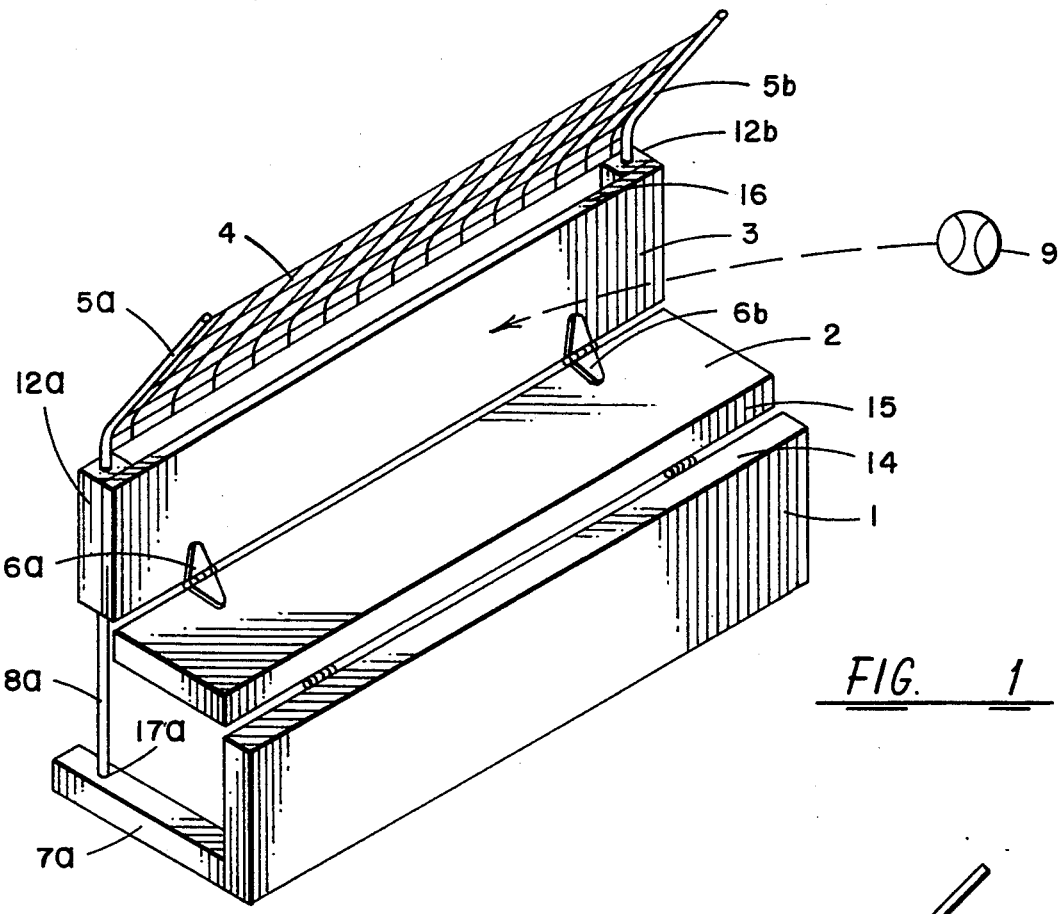
FIG. 1 is a perspective view of the game apparatus with a ball.
Figure 2:
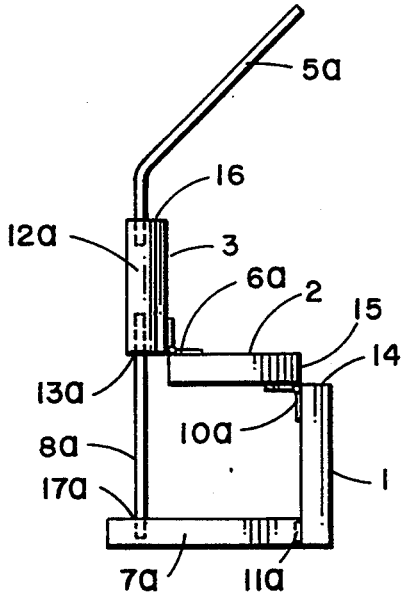
FIG. 2 is a plan side view of the game apparatus which is the subject of this invention.

Referring now to the drawings, in FIGS. 1–4 the invention as shown has three steps, a vertical bottom step 1, a horizontal middle step 2 and vertical top step 3. Each step has one exposed face and an exposed edge 14, 15 and 16 for step 1, 2 and 3, respectively, which a ball 9 may strike when thrown toward the apparatus. A net 4 is suspended between two poles **5*a* and 5*b* from back supports 12*a* and 12*b* attached to the top step 3. The net 4 acts not only as a back stop to prevent a ball 9 from going over the apparatus, but also serves to ricochet the ball 9 back to the steps. Horizontal base supports 7*a* and 7*b* extend backward from step 1 a sufficient length so that dowels 8*a* and 8*b* may be inserted into holes 16*a* and 16*b*, a base support 7*a* and holes 17*a* and 17*b* in back supports 12*a* and 12*b* on the top step 3** to maintain the flight of the steps in a flight when a game is being played.

FIGS. 1–4 also illustrate an arrangement of hinges which makes the game apparatus collapsible. For instance, between the inside of base supports **7*a* and 7*b* and the first step 1 are hinges 11*a* and 11*b* which enables base supports 7*a* and 7*b* to be folded inward against the back of step 1. Another set of hinges 10*a* and 10*b* on the inside of the intersection of step 1 and step 2 enables steps 1 and 2 to be folded together. Finally, hinges 6*a* and 6*b* connecting steps 2 and 3 enables steps 2 and 3 to be folded together. Of course, prior to folding the steps together, the dowels 8*a* and 8*b* must be removed from the base supports 7*a* and 7*b* and top step back supports 12*a* and 12*b***.

Figure 3:
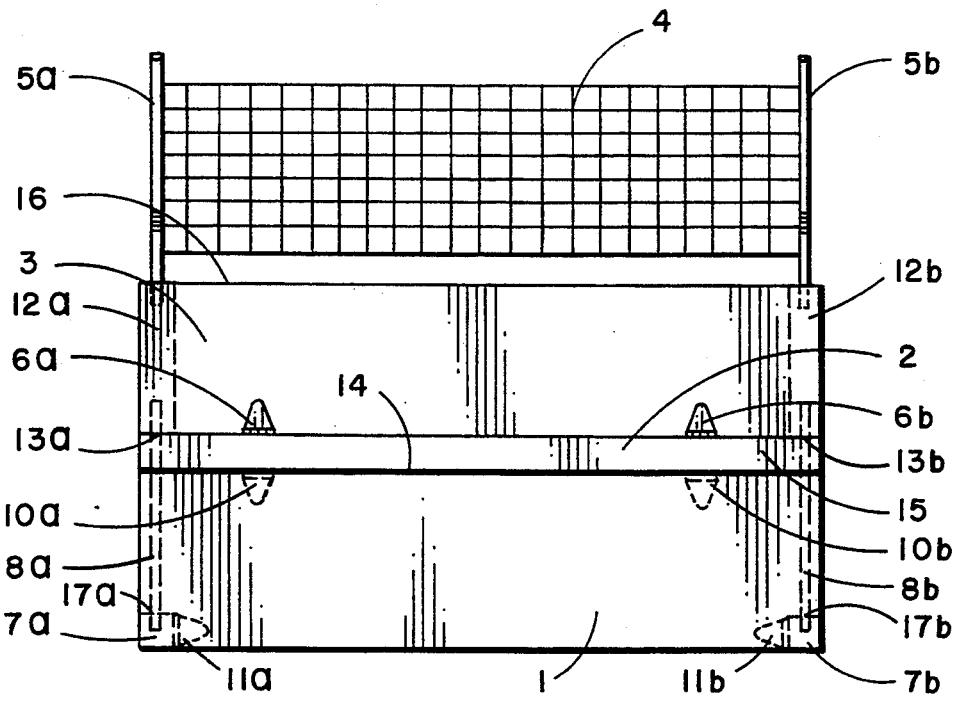
FIG. 3 is a plan front view of the game apparatus.
Figure 4:
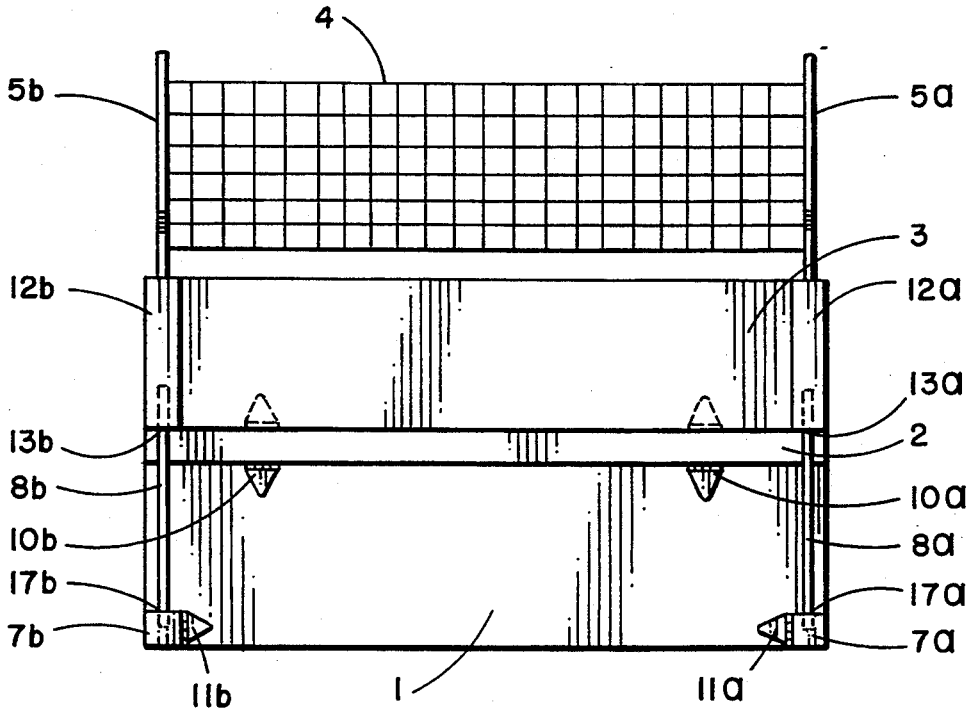
FIG. 4 is a plan rear view of the game apparatus.

FIG. 3 shows all components of the device in plan view looking from the front. The same components are also shown in FIG. 4 from a rear view.

Figure 5:
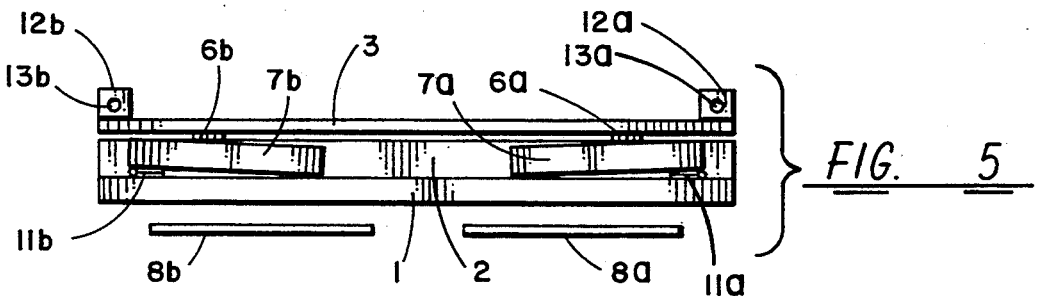
FIG. 5 is a rear view of the game apparatus in a collapsed state for easier handling during transportation and storage.

The final drawing figure, FIG. 5, shows the game apparatus in its collapsed state for easy handling and storage. To collapse the apparatus, one first needs to remove the dowels 8*a* and 8*b* and the net poles 5*a* and 5*b* which can be used to fold or roll the net 4 into a compact piece. Then the base supports 7*a* and 7*b* are folded inward until they are against the back of step 1. Finally, the steps 1, 2 and 3 can be folded together to form a very flat and compact package for easy handling and storage.

This game apparatus may be made of almost any rigid material, such as wood, metal or plastic. The hinges can be made of wood, metal or plastic. The net 4 can be made of almost any material commonly used to make nets, such as cloth, string or other similar material. Although many games using a ball could be played using this game apparatus, the game apparatus has been designed primarily to play a game known as curb ball. Prior to playing the game, if one starts with the game apparatus in a collapsed state, the apparatus is assembled merely by unfolding the steps and placing it on a leveled surface. Then the dowels 8*a* and 8*b* are placed into the holes 17*a* and 17*b* provided on the base supports 7*a* and 7*b* and top step back supports 12*a* and 12*b*. Then, the net poles 5*a* and 5*b* are inserted into the holes on the top step back support 12*a* and 12*b*.

The game is normally played with two players at a time, although even one person could utilize it to practice coordination and proficiency in ball handling. The ball 9 is thrown with force toward the device to strike one of the exposed faces or edges of the steps. Each player has three outs in one inning and one game equals 9 innings, similar to baseball. A receiving or non-throwing player must catch the ball on the first bounce for an out. If the ball is dropped, it is called a "hit" which counts as a single putting a player on first. If the non-throwing player touches the ball, but the ball is not caught or the ball gets by that player, then the "hit" counts as a double. If the ball goes over the head of the non-throwing player by approximately five (5) feet, then the "hit" counts as a triple. Finally, if the ball goes ten (10) feet or more over the head of a non-throwing player, then the hit counts as a home run. Players must establish "foul" or "out-of-bound" lines prior to beginning the game. These rules and playing area can vary depending on space availability.

Thus, the present invention has provided a game apparatus for use in playing a ball game which can be played indoors or outdoors in a relatively small area and can be handled and stored in a compact package due to its collapsibility for improving coordination and proficiency in ball handling all while providing many hours of enjoyment to the players.

Although only one preferred embodiment of the present invention has been described in detail hereinabove, all improvements, modifications and other foreseeable variations are included in this invention as set forth in the claims.

Having thus described my invention, I claim:

1. A portable game apparatus for playing a game using a ball comprising:

a plurality of steps arranged in a flight, including a vertical bottom step and a vertical top step, each step having a face side and an exposed edge which the ball may strike, a bottom edge and a back side;

means for supporting the plurality of steps in a flight comprising two base supports each attached to and extending backward from opposite sides of the back side of the bottom first step and two back supports attached vertically to opposite ends of the top step, and a dowel inserted into holes in each base support and back support on the top step; and a net suspended between two poles attached at opposite ends of the top step.

2. The portable game apparatus of claim 1 wherein the plurality of steps comprises three steps, a bottom vertical first step, a horizontal middle second step connected to a top edge of the first step and a vertical top third step connected to the horizontal middle second step.

3. The portable game apparatus of claim 2, wherein the net is bent forward toward the face side of the steps at an angle of approximately 45°.

4. The portable game apparatus of claim 3 further comprising means for collapsing the game apparatus so that all steps are horizontal for easy handling and storage.

5. The portable game apparatus of claim 2 further comprising means for collapsing the game apparatus so that all steps are horizontal for easy handling and storage.

6. The portable game apparatus of claim 1 wherein the net is bent forward toward the face side of the steps at an angle of approximately 45°.

7. The portable game apparatus of claim 6 further comprising means for collapsing the game apparatus so that all steps are horizontal for easy handling and storage.

8. The portable game apparatus of claim 1 further comprising means for collapsing the game apparatus so that all steps are horizontal for easy handling and storage.

9. The portable game apparatus of claim 8, 5, 7 or 4 wherein the means for collapsing the game apparatus comprises at least one hinge attached at an intersection of each step, at least one hinge between the base support and the bottom step and removable dowels such that the dowels may be removed from holes in the base support and back supports to allow the base supports to be folded inward against the bottom step and then the steps folded into each other to form a relatively flat, compact package for easy handling and storage.

* * * * *